US012376635B2

(12) United States Patent
Yonemitsu

(10) Patent No.: US 12,376,635 B2
(45) Date of Patent: Aug. 5, 2025

(54) GLOVE

(71) Applicant: SHOWA GLOVE CO., Himeji (JP)

(72) Inventor: Hosei Yonemitsu, Himeji (JP)

(73) Assignee: SHOWA GLOVE CO., Himeji (JP)

( * ) Notice: Subject to any disclaimer, the term of this patent is extended or adjusted under 35 U.S.C. 154(b) by 0 days.

(21) Appl. No.: 18/464,765

(22) Filed: Sep. 11, 2023

(65) Prior Publication Data

US 2024/0130453 A1 Apr. 25, 2024
US 2024/0225153 A9 Jul. 11, 2024

(30) Foreign Application Priority Data

Oct. 20, 2022 (JP) ..... 2022-168126

(51) Int. Cl.
*A41D 19/015* (2006.01)
*A41D 31/26* (2019.01)

(52) U.S. Cl.
CPC ..... *A41D 19/015* (2013.01); *A41D 31/26* (2019.02)

(58) Field of Classification Search
CPC .. A41D 19/015; A41D 31/26; A41D 19/0006; A41D 19/01547; A41D 19/01511; A41D 19/0044; D02G 3/442
See application file for complete search history.

(56) References Cited

U.S. PATENT DOCUMENTS

RE37,430 E 10/2001 Toon
9,587,333 B1 3/2017 Ellsworth
9,788,585 B2 10/2017 Thompson et al.
2011/0289654 A1* 12/2011 Williams ..... G06F 3/044 2/167

(Continued)

FOREIGN PATENT DOCUMENTS

JP S57-161899 U 10/1982
KR 10-1240837 B1 2/2013

*Primary Examiner* — Khoa D Huynh
*Assistant Examiner* — Erick I Lopez
(74) *Attorney, Agent, or Firm* — Norris McLaughlin, P.A.

(57) ABSTRACT

An aspect of the present invention is a glove including a glove main body knitted with a yarn made of fiber, the glove main body including: a main body portion; five finger-receiving portions each having a bottomed cylindrical shape; and a cylindrical cuff portion, wherein the main body portion is formed into a bag shape to cover a palm and a dorsal side of a wearer's hand, the five finger-receiving portions extend from the main body portion to cover each of a first finger to a fifth finger of the wearer, and the cuff portion extends in a direction opposite to the five finger-receiving portions, in at least a part of a palm part, the main body portion has a repeating structure of: a strip-shaped electrically conductive part containing an electrically conductive yarn; and a strip-shaped electrically non-conductive part not containing the electrically conductive yarn, the main body portion has unevenness on a front face thereof, in which the electrically conductive part is a concave portion and the electrically non-conductive part is a convex portion, the electrically conductive part consists of an electrically conductive composite yarn including: the electrically conductive yarn; and a core yarn covered with the electrically conductive yarn, the electrically conductive yarn is disposed across the front face and a back face of the main body portion, and an elongation rate of the core yarn is no greater than 3%.

8 Claims, 7 Drawing Sheets

(56) References Cited

U.S. PATENT DOCUMENTS

| | | | | |
|---|---|---|---|---|
| 2015/0181956 | A1* | 7/2015 | Andrews | A41D 19/0006 2/167 |
| 2016/0073713 | A1* | 3/2016 | Takata | D02G 3/442 2/167 |
| 2023/0095403 | A1* | 3/2023 | Uesugi | D02G 3/46 57/293 |

* cited by examiner

GLOVE

BACKGROUND OF THE INVENTION

Field of Invention

The present invention relates to a glove.

Description of the Related Art

As a working glove, one eliminating electrification is known (for example, see Japanese Examined Utility Model Application Publication No. S57-161899). Such a working glove has electrical conductivity and enables reducing risks of work in a combustible or explosive atmosphere and/or inhibiting electrostatic breakdown of an electronic device as an object for gripping.

On the other hand, when a resistance value of the glove becomes too low, for example, a worker may be electrically shocked, and in a case of gripping an electronic device, an electrical short circuit failure may be caused. Thus, the working glove is made to be a so-called antistatic glove in which electrically conductive fiber is used together with electrically non-conductive fiber and an amount of the electrically conductive fiber is adjusted such that a desired electrical resistance value (volume resistance value) is obtained as a whole.

PRIOR ART DOCUMENTS

Patent Documents

[Patent Document 1] Japanese Examined Utility Model Application Publication No. S57-161899

SUMMARY OF THE INVENTION

In the conventional antistatic glove, a content of the electrically conductive fiber is approximately 0.01% by mass to 5% by mass. It is considered that this content corresponds to a proportion of a surface area of the glove; therefore, of the surface of the glove, a part exhibiting electrical conductivity accounts for no greater than 5%. In such a case, when the electrically conductive fiber, being comparatively small in amount, is abraded, the electrical conductivity of the glove may greatly fluctuate, or the glove may no longer exhibit electrical conductivity. Thus, to maintain an electrically conductive function of the antistatic glove and ensure durability, it is important to prevent abrasion of an electrically conductive yarn.

The present invention was made in view of the foregoing circumstances, and an object of the invention is to provide a glove having a volume resistance value that easily falls within a certain range and being superior in durability.

An aspect of the present invention is a glove including a glove main body knitted with a yarn made of fiber, the glove main body including: a main body portion; five finger-receiving portions each having a bottomed cylindrical shape; and a cylindrical cuff portion, wherein the main body portion is formed into a bag shape to cover a palm and a dorsal side of a wearer's hand, the five finger-receiving portions extend from the main body portion to cover each of a first finger to a fifth finger of the wearer, and the cuff portion extends in a direction opposite to the five finger-receiving portions, in at least a part of a palm part, the main body portion has a repeating structure of: a strip-shaped electrically conductive part containing an electrically conductive yarn; and a strip-shaped electrically non-conductive part not containing the electrically conductive yarn, the main body portion has unevenness on a front face thereof, in which the electrically conductive part is a concave portion and the electrically non-conductive part is a convex portion, the electrically conductive part consists of an electrically conductive composite yarn including: the electrically conductive yarn; and a core yarn covered with the electrically conductive yarn, the electrically conductive yarn is disposed across the front face and a back face of the main body portion, and an elongation rate of the core yarn is no greater than 3%.

Effects of the Invention

The glove of the present invention has a volume resistance value that easily falls within a certain range and is superior in durability.

DESCRIPTION OF THE PREFERRED EMBODIMENTS

Figure 1:
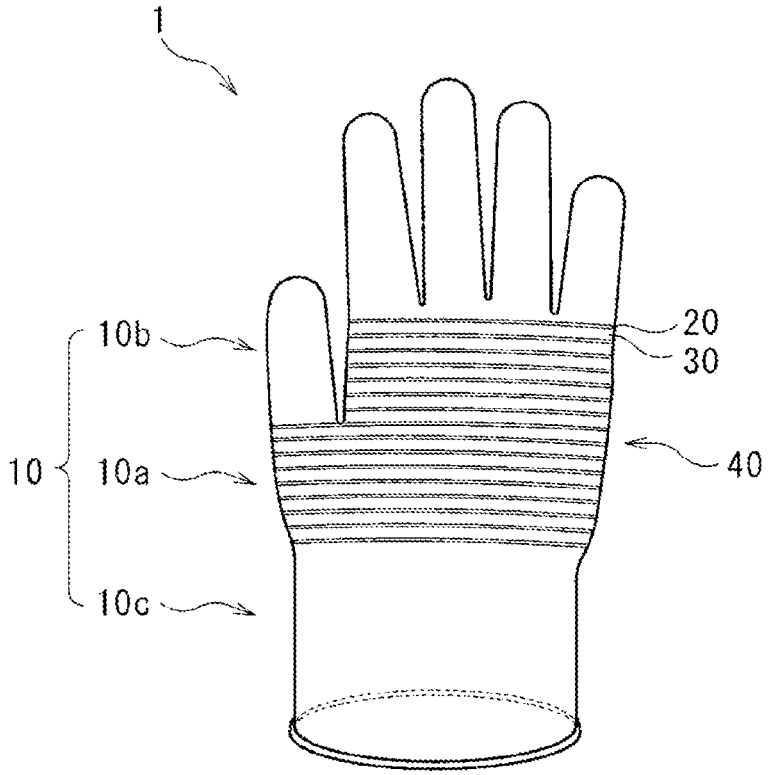
FIG. 1 is a schematic perspective view from a palm side of a glove according to an embodiment of the present invention.

Description of Embodiments of the Present Invention

Firstly, embodiments of the present invention are listed and described.

An aspect of the present invention is a glove including a glove main body knitted with a yarn made of fiber, the glove main body including: a main body portion; five finger-receiving portions each having a bottomed cylindrical shape; and a cylindrical cuff portion, wherein the main body portion is formed into a bag shape to cover a palm and a dorsal side of a wearer's hand, the five finger-receiving portions extend from the main body portion to cover each of a first finger to a fifth finger of the wearer, and the cuff portion extends in a direction opposite to the five finger-receiving portions, in at least a part of a palm part, the main body portion has a repeating structure of: a strip-shaped electrically conductive part containing an electrically conductive yarn; and a strip-shaped electrically non-conductive part not containing the electrically conductive yarn, the main body portion has unevenness on a front face thereof, in which the electrically conductive part is a concave portion and the electrically non-conductive part is a convex portion, the electrically conductive part consists of an electrically conductive composite yarn including: the electrically conductive yarn; and a core yarn covered with the electrically conductive yarn, the electrically conductive yarn is disposed across the front face and a back face of the main body portion, and an elongation rate of the core yarn is no greater than 3%.

In the glove, with respect to the electrically non-conductive part, which is positioned in the convex portion and disposed such that the electrically conductive part is interposed therein, the electrically conductive part is positioned in the concave portion, and thus, the electrically conductive part does not come into strong contact with an object for gripping. Accordingly, the glove enables preventing abrasion of the electrically conductive yarn. Moreover, in the glove, since the electrically conductive yarn is disposed across the front face and the back face of the main body portion, the volume resistance value which shows electrical conductivity between the front and back faces of the glove can easily fall within a certain range.

The elongation rate of the core yarn is preferably lower than an elongation rate of the electrically conductive yarn. By thus setting the elongation rate of the core yarn to be lower than the elongation rate of the electrically conductive yarn, protrusion of the electrically conductive yarn beyond an outermost face of the glove can be more surely inhibited, while maintaining the contact of the electrically conductive yarn with the object for gripping.

A fineness ratio of an electrically non-conductive yarn, which constitutes the electrically non-conductive part, to the electrically conductive composite yarn is preferably no less than 1.08. By thus setting the fineness ratio to be no less than the lower limit, the unevenness in which the electrically conductive part is the concave portion and the electrically non-conductive part is the convex portion can be easily provided.

An elongation rate of the electrically non-conductive yarn is preferably higher than an elongation rate of the electrically conductive composite yarn. When the elongation rate being higher than that of the electrically conductive composite yarn is thus imparted to the electrically non-conductive yarn, formation of the convex portion, being the electrically non-conductive part, can be facilitated.

The core yarn is preferably a cut-resistant yarn. By thus using the cut-resistant yarn as the core yarn, the worker can be protected from not only electrification but also cutting.

It is preferable that the electrically non-conductive yarn consists of the cut-resistant yarn and a plating yarn and that the plating yarn is a single covered yarn obtained by covering a spandex core yarn. By thus using, as the plating yarn, the single covered yarn obtained by covering the spandex core yarn, the cut-resistant yarn is disposed in a zigzag manner due to a contraction force of the spandex. This zigzag alignment occurs in a thickness direction of the glove, and thus, the electrically non-conductive part becomes thick, thereby improving cut resistance.

The glove preferably further includes an electrically conductive film made of a resin or a rubber, the electrically conductive film coating a part or an entirety of the repeating structure of the main body portion. By thus providing the electrically conductive film made of the resin or the rubber, the electrically conductive film coating the part or the entirety of the repeating structure of the main body portion, anti-slip performance can be imparted, and durability of the glove can be improved.

A yarn obtained by covering a spandex core yarn with nylon fiber is preferably disposed by plating knitting in a region of the front face of the main body portion, the region being coated with the electrically conductive film. By thus disposing the yarn obtained by covering the spandex core yarn with the nylon fiber by plating knitting in the region of the front face of the main body portion, the region being coated with the electrically conductive film, adhesiveness to the electrically conductive film can be improved, and volume resistance value controllability and durability of the glove can be improved.

As referred to herein, the "elongation rate" of a yarn (fiber) is determined by placing marks having an interval of 20 cm therebetween on a 60 cm yarn in a state of hanging a weight of 0.075 g, reading the interval indicated by the marks when the weight is replaced with a weight of 6 g, and calculating an elongated rate according to the following formula. It is to be noted that in a case of using a combination of yarns having different elongation rates, to create a state close to a knitted state, the following operation is conducted before the measurement. In a state in which a weight of 20 g hangs on each yarn, each end is gathered in one bunch to be regarded as a single yarn, and a weight of 0.075 g is set thereon. After that, the weight of 20 g is removed, and the measurement is started.

$$[\text{Elongation rate}]=([\text{interval (cm) at time of hanging weight of 6 g}]-20)/20\times100(\%)$$

Details of Embodiments of the Present Invention

Hereafter, the glove according to each embodiment of the present invention is described with reference to the drawings as appropriate.

First Embodiment

A glove 1 illustrated in FIG. 1 includes a glove main body 10 knitted with a yarn made of fiber.

The glove main body 10 includes a main body portion 10*a*, five finger-receiving portions 10*b* each having a bottomed cylindrical shape, and a cylindrical cuff portion 10*c*. The main body portion 10*a* is formed into a bag shape to cover a palm and a dorsal side of a wearer's hand. The five finger-receiving portions 10*b* extend from the main body portion 10*a* to cover each of a first finger to a fifth finger of the wearer. The cuff portion 10*c* extends in a direction opposite to the five finger-receiving portions 10*b*.

Repeating Structure

Figure 2:
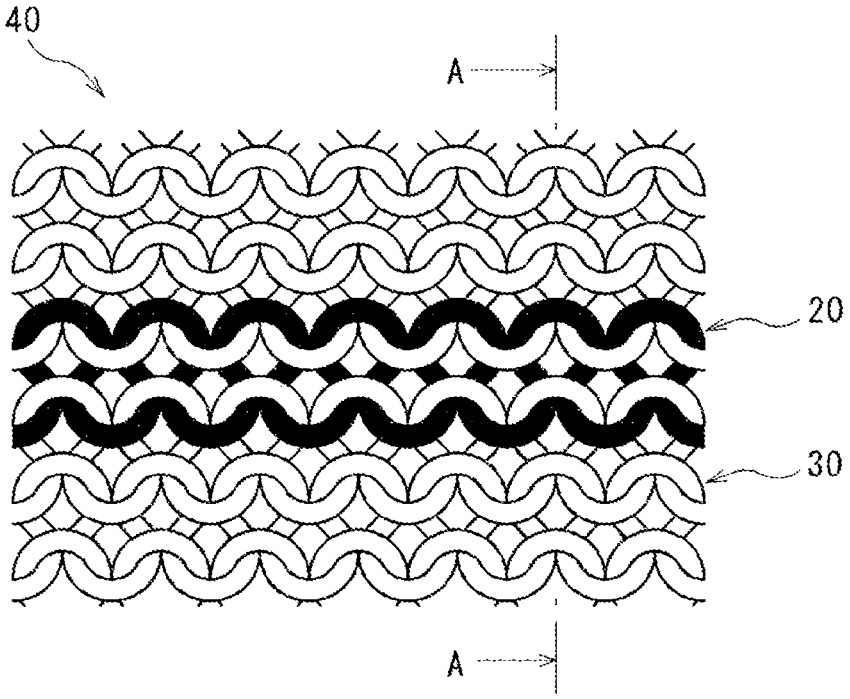
FIG. 2 is an enlarged schematic plan view of a repeating structure part in FIG. 1.
Figure 3:
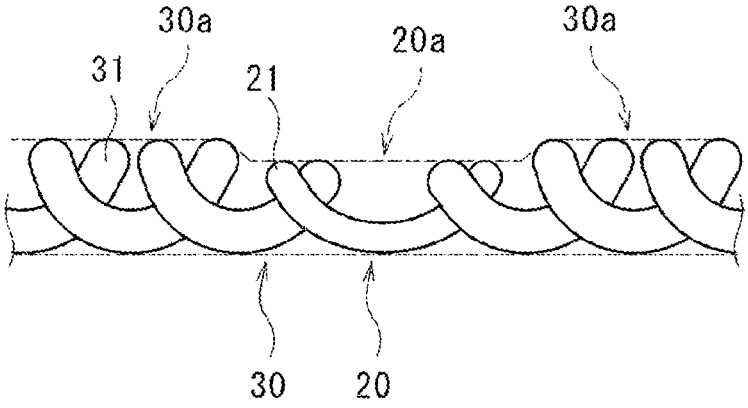
FIG. 3 is a schematic cross-sectional view taken along line A-A in FIG. 2.

As illustrated in FIGS. 2 and 3, in at least a part of a palm part, the main body portion 10*a* has a repeating structure 40 of: a strip-shaped electrically conductive part 20 containing an electrically conductive yarn 21; and a strip-shaped electrically non-conductive part 30 not containing the electrically conductive yarn 21. Furthermore, as illustrated in FIG. 3, the main body portion 10*a* has unevenness on a front face thereof, in which the electrically conductive part 20 is a concave portion 20*a* and the electrically non-conductive part 30 is a convex portion 30*a*.

As illustrated in FIG. 1, the repeating structure 40 is preferably provided to cover an entirety of the palm part. An object for gripping is held on the palm part in many cases, but an electronic component can be protected regardless of which site of the palm part abuts on the object for gripping. Furthermore, the repeating structure 40 may cover the dorsal side of the hand. By providing the repeating structure 40 also on the dorsal side, safety can also be improved in a dorsal portion.

The lower limit of a ratio of the number of courses of the electrically conductive part 20 to the number of courses of the electrically non-conductive part 30, the electrically conductive part 20 and the electrically non-conductive part 30 being adjacent to each other, is 1:2 and more preferably 1:3. On the other hand, the upper limit of the ratio of the number of courses is 1:5 and more preferably 1:4. When the ratio of the number of courses is less than the lower limit, there may be a case in which a width of the electrically non-conductive part 30 which constitutes the convex portion 30*a* is relatively narrow, and due to deformation thereof, the electrically conductive part 20 which constitutes the concave portion 20*a* comes into strong contact with an object for gripping. Thus, an abrasion-preventing effect of the electrically conductive yarn 21 may be degraded. Conversely, when the ratio of the number of courses is greater than the upper limit, a volume resistance value of the repeating structure 40 becomes so high that the worker may be susceptible to electrification.

The number of courses of the electrically conductive part 20 is preferably no less than 1 course and no greater than 3 courses, more preferably no less than 1 course and no greater than 2 courses, and still more preferably 1 course. By thus setting the number of courses of the electrically conductive part 20 to fall within the above range, a width of the electrically conductive part 20 interposed in the electrically non-conductive part 30 is limited, whereby the abrasion-preventing effect of the electrically conductive yarn 21 can be easily improved.

In the repeating structure 40, the lower limit of the volume resistance value specified in EN 61340-2-3 is preferably $3.5\times10^3\Omega$ and more preferably $1.0\times10^4\Omega$. On the other hand, the upper limit of the volume resistance value is preferably $1.0\times10^8\Omega$ and more preferably $1.0\times10^7\Omega$. When the volume resistance value is less than the lower limit, an electrical short circuit failure may occur at a time of gripping an object for gripping. Conversely, when the volume resistance value is greater than the upper limit, the worker may be susceptible to electrification. Furthermore, when the volume resistance value is greater than $1.0\times10^8\Omega$, EN 16350 standard is not satisfied. It is to be noted that the "volume resistance value" and the "surface resistance value" as referred to herein are measured according to EN 61340-2-3:2016 8, which is an EN standard, and a measurement sample is cut out from a central portion of the repeating structure of the palm part for which electrical conductivity is required.

In the repeating structure 40, the lower limit of the surface resistance value specified in EN 61340-2-3 is preferably $3.5\times10^3\Omega$ and more preferably $1.0\times10^4\Omega$. The upper limit of the surface resistance value is preferably $1.0\times10^8\Omega$ and more preferably $1.0\times10^7\Omega$. By thus setting the surface resistance value to fall within the above range, while maintaining performance for protecting an electronic component, explosion-proof performance can be further improved, and operability of a touch panel can be improved.

As referred to herein, the "volume resistance value" and the "surface resistance value" are measured according to EN 61340-2-3:2016 8, which is the EN standard, and a measurement sample is cut out from the central portion of the repeating structure 40 of the palm part for which electrical conductivity and an explosion-proof property are required.

Conductive Part

Figure 4:
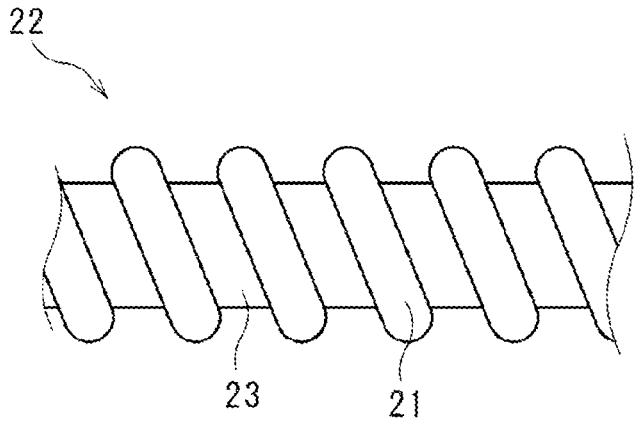
FIG. 4 is a schematic side view illustrating a configuration of an electrically conductive composite yarn.

The electrically conductive part 20 consists of an electrically conductive composite yarn 22 illustrated in FIG. 4. The electrically conductive composite yarn 22 includes an electrically conductive yarn 21 and a core yarn 23, and the core yarn 23 is covered with the electrically conductive yarn 21. Such a configuration in which the electrically conductive yarn 21 covers the core yarn 23 enables avoiding uneven distribution of the electrically conductive yarn 21, and the electrically conductive yarn 21 can easily come into contact with the worker's hand and/or a gripped object from any direction. Thus, electrical conductivity can be easily ensured.

The electrically conductive yarn 21 is disposed across the front face and a back face of the main body portion 10*a*. In other words, the electrically conductive composite yarn 22 is knitted to shuttle between the front face and the back face of the main body portion 10*a*, and there exists an electrically conductive path which allows an electrical short circuit between the front face and the back face of the main body portion 10*a*. In the glove 1, since the electrically conductive yarn 21 is disposed in the concave portion 20*a*, the electrically conductive yarn 21 is positioned at a lower level than the electrically non-conductive part 30 (convex portion 30*a*) in which the concave portion 20*a* is interposed. When a hand wearing the glove 1 grips an object for gripping, due to deformation of the convex portion 30*a*, the concave portion 20*a* also comes into contact with the object for gripping, but this is not strong contact; thus, for example, by appropriately setting a height of the unevenness, moderate contact resistance with the object for gripping can be generated. In the glove 1, owing to the moderate contact resistance and the electrically conductive path, the volume resistance value in the repeating structure 40 is controlled to fall within the certain range.

The electrically conductive yarn 21 can be exemplified by a yarn containing electrically conductive fiber such as carbon composite organic fiber, metal oxide composite organic fiber, metal compound composite organic fiber, metal plating organic fiber, or the like, and for example, Clacarbo (registered trademark), manufactured by Kuraray Co., Ltd., Belltron (registered trademark), manufactured by SEIREN CO., LTD., Thunderon (registered trademark), manufactured by Nihon Sanmo Dyeing Co., Ltd., AGposs (registered trademark), manufactured by Mitsufuji Corporation, etc. may be used.

The lower limit of a fineness of a yarn consisting of such fiber is preferably 10 dtex and more preferably 20 dtex. On the other hand, the upper limit of the fineness of the yarn is preferably 50 dtex and more preferably 40 dtex. By setting the fineness of the yarn to fall within the above range, electrical conductivity of the repeating structure 40 can be ensured, strength of the glove 1 can be maintained, and electrical conductivity can be maintained for a long period of time. When the fineness of the yarn is less than the lower limit, durability of the electrically conductive yarn 21 may be degraded. Conversely, when the fineness of the yarn is greater than the upper limit, the glove 1 after knitting may become hard and/or manufacturing cost of the glove 1 may become too high.

The upper limit of an elongation rate of the electrically conductive yarn 21 is preferably 10% and more preferably 5%. By setting the elongation rate of the electrically conductive yarn 21 to be no greater than the upper limit, protrusion of the electrically conductive yarn 21 beyond an outermost face of the glove 1 can be more surely inhibited. Accordingly, cutting of the electrically conductive yarn 21 can be prevented, thereby improving durability of the glove 1. Furthermore, the lower limit of the elongation rate of the electrically conductive yarn 21 may be 0%, which is a theoretical limit, but is preferably 1%.

The core yarn 23 is preferably a cut-resistant yarn. By thus using the cut-resistant yarn as the core yarn 23, the worker can be protected from not only electrification but also cutting. As long as cut-resistant performance can be obtained, a composite yarn in which a plurality of yarns including the cut-resistant yarn and a non-cut-resistant yarn are combined may be adopted. Examples of such a non-cut-resistant yarn include a cotton yarn, microfiber, and the like for the purpose of absorbing moisture.

Aside from an ultra-high molecular weight polyethylene yarn, a highly drawn polyethylene yarn, a liquid crystal polyester yarn, an aramid yarn, a glass fiber yarn, a glass fiber composite yarn, and a polyparaphenylene benzoxazole (PBO) yarn, examples of the cut-resistant yarn which may be used include: a yarn consisting of high-hardness filler-containing organic fiber in which a high-hardness filler such as glass fiber, carbon fiber, silicon nitride, boron nitride, or silicon carbide is dispersed in organic fiber such as polyethylene fiber or polyester fiber; and the like. The above yarn may be a single yarn or a combination of these yarns.

A mode of the core yarn 23 may be either a filament yarn or a spun yarn. In the case in which the core yarn 23 is the filament yarn, the core yarn 23 may be in a straight shape or may be crimped. In the case of the straight shape, an interlacing process may be further conducted to prevent the fibers from becoming loose. Here, when a stretch yarn shrinks, a constituent fiber thereof shrinks while bending. In other words, the yarn occupies a significantly large space with respect to a volume of the constituent fiber itself. In light of suppressing the volume of the space occupied by the core yarn 23 by inhibiting expansion and contraction of the core yarn 23, either the filament yarn or the spun yarn may be used; however, of these, the filament yarn is preferred in light of flexibility, and a straight-shaped filament yarn is more preferred in light of strength. It is to be noted that purposes of suppressing the volume of the space occupied by the core yarn 23 are to inhibit a decrease in electrical conductivity, when the volume of the electrically conductive yarn 21 in the electrically conductive composite yarn 22 becomes relatively small, and to inhibit likelihood of abrasion due to outward spreading of the electrically conductive yarn 21.

The upper limit of an elongation rate of the core yarn 23 is 3% and more preferably 1.5%. By setting the elongation rate of the core yarn 23 to be no greater than the upper limit, stretch of the core yarn 23 can be inhibited. Accordingly, cutting of the electrically conductive yarn 21, which is wound on the core yarn 23 and is more stretchable than the core yarn 23, can be prevented, thereby improving durability of the glove 1. It is to be noted that the lower limit of the elongation rate of the core yarn 23 is not particularly limited and may be 0%, which is the theoretical limit.

The elongation rate of the core yarn 23 is preferably lower than the elongation rate of the electrically conductive yarn 21. By thus setting the elongation rate of the core yarn 23 to be lower than the elongation rate of the electrically conductive yarn 21, protrusion of the electrically conductive yarn 21 beyond the outermost face of the glove 1 can be more surely inhibited, while maintaining contact of the electrically conductive yarn 21 with an object for gripping.

In the case in which a yarn consisting of organic fiber, e.g., an ultra-high molecular weight polyethylene yarn or an aramid yarn, and/or high-hardness filler-containing organic fiber is used as the core yarn 23, the lower limit of a fineness thereof is, in light of strength, preferably 50 dtex and more preferably 100 dtex. On the other hand, the upper limit of the fineness is, in light of texture of the glove 1, preferably 600 dtex, more preferably 500 dtex, and still more preferably 350 dtex.

In the case of using the glass fiber yarn as the core yarn 23, the lower limit of a fineness thereof is, in light of strength, preferably 50 dtex. On the other hand, the upper limit of the fineness is, in light of texture of the glove 1, preferably 250 dtex and more preferably 200 dtex.

In the case in which the core yarn 23 is the cut-resistant yarn, the lower limit of a fineness of the core yarn 23 is, in light of surely imparting cut resistance, preferably 50 dtex, more preferably 100 dtex, and still more preferably 150 dtex. On the other hand, the upper limit of the fineness of the core yarn 23 is, in light of texture of the glove 1, preferably 600 dtex, more preferably 500 dtex, and still more preferably 350 dtex.

In the electrically conductive composite yarn 22, the lower limit of the number of turns of the electrically conductive yarn 21 per unit length of the core yarn 23 is preferably 100 times/m and more preferably 150 times/m. On the other hand, the upper limit of the number of turns is preferably 500 times/m and more preferably 450 times/m. When the number of turns is less than the lower limit, the electrically conductive yarn 21 may be likely to be unevenly distributed. Conversely, when the number of turns is greater than the upper limit, flexibility of the glove 1 may be degraded.

The lower limit of a fineness of the electrically conductive composite yarn 22 is preferably 60 dtex, more preferably 120 dtex, still more preferably 160 dtex, and particularly preferably 200 dtex. On the other hand, the upper limit of the fineness of the electrically conductive composite yarn 22 is preferably 650 dtex, more preferably 600 dtex, still more preferably 500 dtex, and particularly preferably 400 dtex. When the fineness of the electrically conductive composite yarn 22 is less than the lower limit, it may be difficult to achieve both the electrical conductivity and the strength. Conversely, when the fineness of the electrically conductive composite yarn 22 is greater than the upper limit, flexibility of the glove 1 may be degraded. It is to be noted that in the case of using the cut-resistant yarn as the core yarn 23 of the electrically conductive composite yarn 22, in light of ensuring cut resistance, the fineness of the electrically conductive composite yarn 22 is preferably no less than 120 dtex.

The upper limit of an elongation rate of the electrically conductive composite yarn 22 is preferably 3% and more preferably 1.5%. By setting the elongation rate of the electrically conductive composite yarn 22 to be no greater than the upper limit, a volume of a space occupied by the electrically conductive composite yarn 22 in the palm part can be easily suppressed. Accordingly, the contact resistance can be controlled and abrasion of the electrically conductive composite yarn 22 can be inhibited, and the volume resistance value in the repeating structure 40 can be easily controlled to fall within the certain range. It is to be noted that the lower limit of the elongation rate of the electrically conductive composite yarn 22 is not particularly limited and may be 0%, which is the theoretical limit.

Electrically Non-Conductive Part

The electrically non-conductive part 30 consists of an electrically non-conductive yarn 31.

In a case in which the glove main body 10 is knitted by flat knitting, it is preferable that the electrically non-conductive yarn 31 is a yarn which is bulkier than the electrically conductive composite yarn 22; in other words, it is preferable that a fineness of the electrically non-conductive yarn 31 is higher than the fineness of the electrically conductive composite yarn 22, or that only the electrically non-conductive yarn 31 contains a bulk-processed yarn such as a crimped yarn. Consequently, the electrically non-conductive part 30 is formed as the convex portion 30*a*. By thus serving as the convex portion 30*a*, the electrically non-conductive part 30 comes into contact with the worker's hand and/or a gripped object, more strongly than the electrically conductive yarn 21 positioned in the concave portion 20*a*. Owing to this configuration, the glove 1 enables preventing abrasion of the electrically conductive yarn 21 and ensuring electrical conductivity for a long period of time.

The lower limit of a fineness ratio of the electrically non-conductive yarn 31, which constitutes the electrically non-conductive part 30, to the electrically conductive composite yarn 22 is preferably 1.08 and more preferably 1.13. On the other hand, the upper limit of the fineness ratio is preferably 1.8 and more preferably 1.6. When the fineness ratio is less than the lower limit, unevenness of the glove main body 10 may be insufficient, and the abrasion-preventing effect of the electrically conductive yarn 21 may be degraded. Conversely, when the fineness ratio is greater than the upper limit, the unevenness may become too deep to sufficiently ensure the contact between the electrically conductive yarn 21 and a gripped object, and the electrical conductivity may be insufficient.

The lower limit of an elongation rate of the electrically non-conductive yarn 31 is preferably 10% and more preferably 20%. The upper limit of the elongation rate of the electrically non-conductive yarn 31 is preferably 400% and more preferably 300%. By setting the elongation rate of the electrically non-conductive yarn 31 to fall within the above range, the contact resistance can be controlled and abrasion of the electrically conductive yarn 21 can be inhibited, and the volume resistance value in the repeating structure 40 can be easily controlled to fall within the certain range. When the elongation rate of the electrically non-conductive yarn 31 is less than the lower limit, a volume of a space occupied by the electrically non-conductive yarn 31 in the palm part may be small, making it difficult to form the convex portion, whereby the contact between the electrically conductive yarn 21 and an object for gripping is increased, making it difficult to control the volume resistance value, and abrasion of the electrically conductive yarn 21 is increased, whereby durability may be likely to be degraded. Conversely, when the elongation rate of the electrically conductive yarn 31 is greater than the upper limit, the volume of the space occupied by the electrically non-conductive yarn 31 may become too large and the unevenness of the glove main body 10 may become too deep to sufficiently ensure the contact between the electrically conductive yarn 21 and an object for gripping, whereby the electrical conductivity may be insufficient.

Furthermore, the elongation rate of the electrically non-conductive yarn 31 is preferably higher than the elongation rate of the electrically conductive composite yarn 22. This makes contraction of the electrically non-conductive part 30 knitted with the electrically non-conductive yarn 31 greater than that of the electrically conductive part 20 knitted with the electrically conductive composite yarn 22; consequently, the electrically non-conductive part 30 can be formed to be bulkier than the electrically conductive part 20. Thus, the convex portion 30*a* of the electrically non-conductive part 30 can be easily formed.

Aside from cotton fiber, polyester fiber, nylon fiber, polyethylene fiber, polypropylene fiber, acrylic fiber, aramid fiber, polyparaphenylene benzoxazole (PBO) fiber, ultra-high molecular weight polyethylene fiber, highly drawn polyethylene fiber, liquid crystal polyester fiber, glass fiber, polyurethane elastic fiber, and natural rubber fiber, examples of a material of the electrically non-conductive yarn 31 include: high-hardness filler-containing organic fiber in which a high-hardness filler such as glass fiber, carbon fiber, silicon nitride, boron nitride, or silicon carbide is dispersed in organic fiber such as polyethylene fiber or polyester fiber; a composite fiber thereof; and the like.

In light of preventing dust generation, the electrically non-conductive yarn 31 is preferably a filament yarn. Furthermore, in light of imparting fitting properties to the glove 1 after knitting, the electrically non-conductive yarn 31 is preferably an elastic yarn.

In the case in which the core yarn 23 of the electrically conductive composite yarn 22 is the cut-resistant yarn, it is preferable that the electrically non-conductive yarn 31 is also the cut-resistant yarn. By thus using the cut-resistant yarn also as the electrically non-conductive yarn 31, uniform cut resistance can be imparted. Furthermore, since the cut-resistant yarn is to be contained in the convex portion 30*a*, abrasion resistance of the convex portion 30*a* is improved, and abrasion resistance of the electrically conductive yarn 21, which is positioned in the concave portion 20*a* protected by the convex portion 30*a*, is also improved. Thus, electrical conductivity of the glove 1 can be maintained for a long period of time. As the cut-resistant yarn, the various kinds of cut-resistant yarns given as examples of the core yarn 23 may be used.

As the electrically non-conductive yarn 31, a plating yarn may be used in addition to the cut-resistant yarn. The plating yarn enables ensuring a volume of the electrically non-conductive part 30 and facilitating formation of the convex portion 30*a*. When particularly a general-purpose yarn such as a polyester yarn, a nylon yarn, a cotton yarn, and/or the like are/is used as the plating yarn, cost of the glove 1 can be reduced, while imparting cut resistance.

The cut-resistant yarn and the plating yarn of the electrically non-conductive yarn 31 may be aligned to be knitted, may be knitted by plating knitting, or may be prepared as a twisted yarn to be flat-knitted.

As the plating yarn of the electrically non-conductive yarn 31, an elastic yarn is preferably used. The elastic yarn is exemplified by a single covered yarn (SCY) obtained by covering a core yarn containing natural rubber fiber and/or polyurethane fiber (spandex) as a material, with nylon fiber, polyester fiber, and/or the like. By thus using, as the plating yarn, the single covered yarn obtained by covering a spandex core yarn, the cut-resistant yarn is disposed in a zigzag manner due to contraction force of the spandex. This zigzag alignment occurs in a thickness direction of the glove 1, and thus, the electrically non-conductive part 30 becomes thick, thereby improving cut resistance. Furthermore, since stretchability of the cut-resistant yarn used in the electrically non-conductive yarn 31 and the electrically conductive composite yarn 22 is low, stitches at least in the electrically conductive part 20 are opened more easily than those in a spandex-containing part of the electrically non-conductive part 30, and thus, breathability can be easily ensured. Thus, the glove 1 to be obtained is a glove having high breathability for the thickness.

In the case in which the plating yarn of the electrically non-conductive yarn 31 is the SCY obtained by covering the spandex, the lower limit of a fineness of the spandex is preferably 10 dtex and more preferably 20 dtex. On the other hand, the upper limit of the fineness of the spandex is preferably 78 dtex, more preferably 56 dtex, and still more preferably 35 dtex. By setting the fineness of the spandex to fall within the above range, the electrically non-conductive part 30 can be made bulky, and the glove 1 can be imparted with proper fit. A yarn used for covering the spandex is preferably a crimped yarn of nylon fiber or polyester fiber subjected to bulk processing, and a fineness of the crimped yarn is preferably no less than 50 dtex and no greater than 156 dtex. Thus, knitting processability can be improved, and the electrically non-conductive part 30 can be made bulkier. Furthermore, a draft at a time of manufacturing the SCY is preferably no less than 2.0 and no greater than 4.5, and the number of turns per unit length of the yarn used for covering is preferably no less than 200 times/m and no greater than 700 times/m.

Finger-Receiving Portions and Cuff Portion

The finger-receiving portions 10*b* and the cuff portion 10*c* may consist of only the electrically conductive part 20 or only the electrically non-conductive part 30, or may have the repeating structure 40 as in the main body portion 10*a*. It is also possible for the finger-receiving portions 10*b* to have a structure different from that of the cuff portion 10*c*. For example, in a case of intended usage at a work site at which a touch panel is used, the finger-receiving portions 10*b* may be knitted as the electrically conductive part 20.

The finger-receiving portions 10*b* and the cuff portion 10*c* may adopt a configuration similar to that of the electrically conductive part 20 or the electrically non-conductive part 30. Furthermore, at a time of knitting, an elastic yarn containing a natural rubber, polyurethane, etc. as a material may be used together to impart stretchability. Yarn(s) to be used in the finger-receiving portions 10*b* and the cuff portion 10*c* may be selected as appropriate in accordance with the intended usage.

Method for Manufacturing Glove

The glove 1 can be manufactured by a manufacturing method including a preparing step, a knitting step, and an inside-out turning step.

Preparing Step

In the preparing step, the electrically conductive composite yarn 22 and the electrically non-conductive yarn 31 are prepared.

Here, the following description is made taking an example in which the cut-resistant yarn is used as the core yarn 23 of the electrically conductive composite yarn 22, and the cut-resistant yarn and the plating yarn are used as the electrically non-conductive yarn 31; however, this does not mean that the electrically conductive composite yarn 22 and the electrically non-conductive yarn 31 are limited to the above combination. Other yarns described above may also be used.

Knitting Step

In the knitting step, the glove main body 10 is knitted with a flat knitting machine by using the yarns prepared in the preparing step.

As a knitting machine used for knitting the glove main body 10, an existing flat knitting machine may be used. Examples of the knitting machine include a flat knitting machine SFG-i and a computer flat knitting machine SWG, which are manufactured by SHIMA SEIKI MFG., LTD., and the like.

The lower limit of the number of gauges of the knitting machine is preferably 13 and more preferably 18. On the other hand, the upper limit of the number of gauges of the knitting machine is preferably 26.

The lower limit of the number of courses per unit length of the glove main body 10 being knitted is preferably 30 courses/inch and more preferably 40 courses/inch. On the other hand, the upper limit of the number of courses per unit length is preferably 60 courses/inch and more preferably 55 courses/inch. By setting the number of courses per unit length to be no less than the lower limit, an interval between the electrically conductive parts 20 being adjacent to each other can be narrowed, thereby stabilizing an explosion-proof function. Furthermore, by setting the number of courses per unit length to be no greater than the upper limit, excessively tight stitches can be prevented, stretchability can be imparted to the glove main body 10, and the glove 1 can easily fit when the hand is bent or stretched.

For example, in the case of using SFG-i as the knitting machine, as yarn feeders which can be used for knitting the glove main body 10, there are a main yarn feeder, a plating yarn feeder, and a two-color switching feeder (color yarn feeder), to which, for example, the cut-resistant yarn of the electrically non-conductive yarn 31, the plating yarn of the electrically non-conductive yarn 31, and the electrically conductive composite yarn 22 are fed, respectively. It is to be noted that feeders for the respective yarns are not limited to the above combination and may be selected as appropriate within a range which satisfies the requirements of the invention of the present application.

The electrically non-conductive part 30 is knitted with the electrically non-conductive yarn 31. Here, the cut-resistant yarn and the plating yarn are knitted by plating knitting. In other words, the cut-resistant yarn of the electrically non-conductive yarn 31 is disposed on a face stitch side, while the plating yarn of the electrically non-conductive yarn 31 is disposed on a back stitch side. The glove 2 being knitted is turned inside out to be used, and therefore, the plating yarn is disposed on the front side of the glove 1. At this time, in the case in which the spandex SCY is used as the plating yarn, a knitted fabric which is knitted to contain the SCY is compressed by the plating yarn, a density of the cut-resistant yarn becomes higher, and the thickness of the electrically non-conductive part 30 is increased, thereby improving cut resistance.

The electrically conductive part 20 is knitted with the electrically conductive composite yarn 22.

Furthermore, during the knitting, by switching between: the cut-resistant yarn and the plating yarn of the electrically non-conductive yarn 31; and the electrically conductive composite yarn 22, the electrically non-conductive part 30 and the electrically conductive part 20 can be alternately formed. Specifically, this operation can be implemented in the following manner: after knitting the electrically non-conductive part 30 by using the main yarn feeder and the plating yarn feeder, these feeders are both stopped, and then, the electrically conductive part 20 is knitted using the two-color switching feeder.

Inside-Out Turning Step

In the inside-out turning step, the glove main body 10 after the knitting step is turned inside out. Thus, the glove 1 desired can be obtained.

Advantages

In the glove 1, with respect to the electrically non-conductive part 30, which is positioned in the convex portion 30*a* and disposed such that the electrically conductive part 20 is interposed therein, the electrically conductive part 20 is positioned in the concave portion 20*a*, and thus, the electrically conductive part 20 does not come into strong contact with an object for gripping. Accordingly, the glove 1 enables preventing abrasion of the electrically conductive yarn 21. Moreover, in the glove 1, since the electrically conductive yarn 21 is disposed across the front face and the back face of the main body portion 10*a*, the volume resistance value which shows electrical conductivity between the front and back faces of the glove 1 can easily fall within the certain range.

Furthermore, in the glove 1, protrusion of the electrically conductive yarn 21 beyond the outermost face of the glove 1 can be inhibited by winding the electrically conductive yarn 21 on the core yarn 23 having the lower elongation rate. Thus, strong contact of the electrically conductive part 20 with an object for gripping can be inhibited more surely, and accordingly, the abrasion-preventing effect of the electrically conductive yarn 21 can be improved. Moreover, in the glove 1, along with the fact that the electrically conductive part 20 does not directly come into strong contact with an object for gripping, volume resistance value controllability is improved.

Second Embodiment

Figure 5:
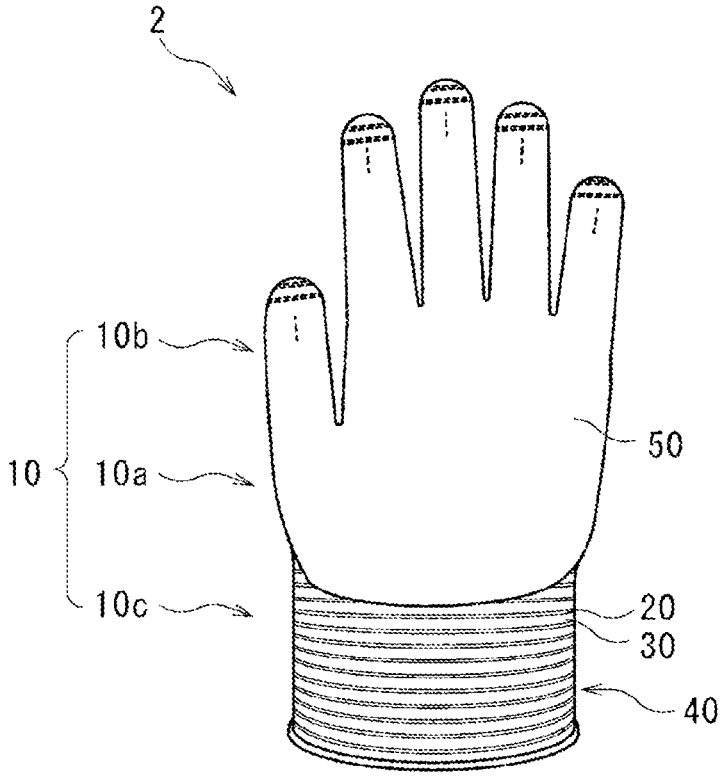
FIG. 5 is a schematic perspective view from a palm side of a glove according to an embodiment different from that in FIG. 1.
Figure 6:
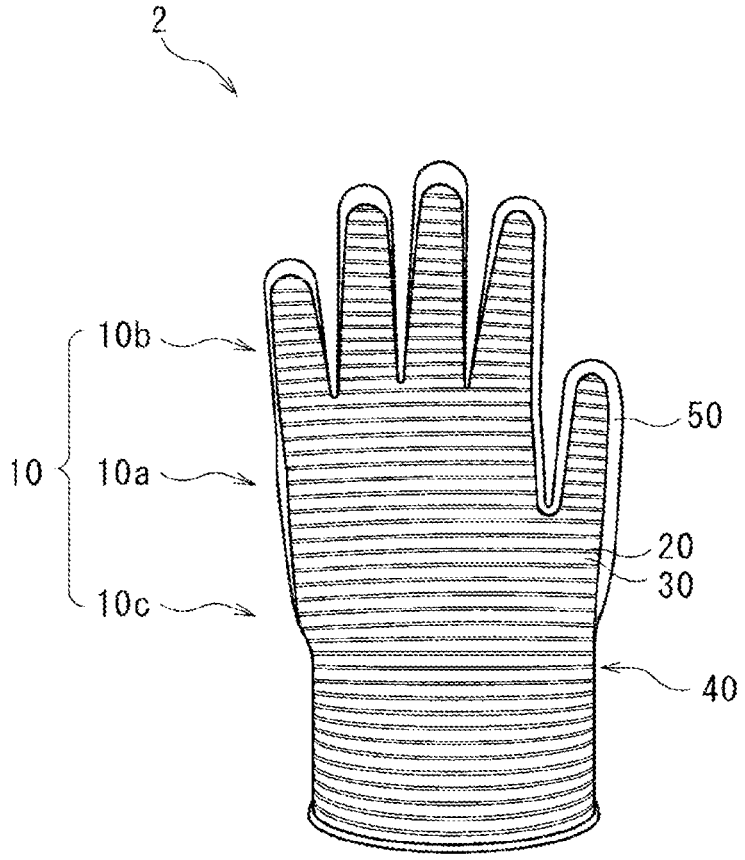
FIG. 6 is a schematic perspective view from a dorsal side of the glove in FIG. 5.

The glove 2 illustrated in FIGS. 5 and 6 includes: the glove main body 10 knitted with a yarn made of fiber; and an electrically conductive film 50, the glove main body 10 including: the main body portion 10*a*; the five finger-receiving portions 10*b* each having a bottomed cylindrical shape; and the cylindrical cuff portion 10*c*, wherein the main body portion 10*a* is formed into a bag shape to cover a palm and a dorsal side of a wearer's hand, the five finger-receiving portions 10*b* extend from the main body portion 10*a* to cover each of a first finger to a fifth finger of the wearer, and the cuff portion 10*c* extends in a direction opposite to the five finger-receiving portions 10*b*, in at least a part of the palm part, the main body portion 10*a* has the repeating structure 40 of: the strip-shaped electrically conductive part 20 containing the electrically conductive yarn 21; and the strip-shaped electrically non-conductive part 30 not containing the electrically conductive yarn 21, the main body portion 10*a* has unevenness on a front face thereof, in which the electrically conductive part 20 is the concave portion 20*a* and the electrically non-conductive part 30 is the convex portion 30*a*, the electrically conductive part 20 consists of the electrically conductive composite yarn 22 including: the electrically conductive yarn 21; and the core yarn 23 covered with the electrically conductive yarn 21, the electrically conductive yarn 21 is disposed across the front face and a back face of the main body portion 10*a*, and an elongation rate of the core yarn 23 is no greater than 3%.

The glove 2 is similar to the glove 1 of the first embodiment, except for the point that the electrically conductive film 50 is provided, and therefore, the same reference symbols are used and description is omitted. It is to be noted that in the glove 2, the repeating structure 40 is provided in the main body portion 10*a*, the finger-receiving portions 10*b*, and the cuff portion 10*c*.

Conductive Film

The electrically conductive film 50 covers a part or an entirety of the repeating structure 40 of the main body portion 10*a* and is made of a resin or a rubber. In the glove 2 illustrated in FIGS. 5 and 6, an entirety of the palm side of the main body portion 10*a* and the finger-receiving portions 10*b*, and a part of the dorsal side of the finger-receiving portions 10*b* are covered with the electrically conductive film 50.

In the case in which the electrically conductive film 50 is made of a resin, a well-known resin may be used as a resin serving as a main component thereof, and examples include polyurethane, polyvinyl chloride, a mixture thereof, and the like. It is to be noted that the "main component" as referred to herein means a component having the highest content, for example, a component having a content of no less than 50% by mass.

In the case in which the electrically conductive film 50 is made of a rubber, a well-known rubber may be used as a rubber serving as a main component thereof, and examples include a natural rubber, an acrylonitrile butadiene rubber, a chloroprene rubber, an acrylic rubber, an isoprene rubber, a styrene-isoprene block copolymer, and a silicone rubber, modified products thereof, mixtures thereof, and the like. Of these, in light of versatility, adhesiveness to the fiber of the glove main body 10, flexibility, and abrasion resistance, a natural rubber, an acrylonitrile butadiene rubber (including modified products thereof), and a chloroprene rubber are preferred.

Furthermore, an electrically conductive filler is preferably added to the electrically conductive film 50 to impart electrical conductivity. As the electrically conductive filler, a well-known filler may be used, and examples thereof include Dentall WK-500B, manufactured by Otsuka Chemical Co., Ltd., Ketjen Black EC300J, manufactured by LION SPECIALTY CHEMICALS CO., LTD., and the like.

The electrically conductive film 50 may contain various types of compounding agents. Examples of the compounding agents include: stabilizers such as emulsifiers and surfactants; vulcanizing agents such as sulfur; vulcanization accelerators such as zinc oxide and zinc diethyldithiocarbamate; cross-linking agents such as diglycidyl ether, polyglycidyl ether, polycarbodiimide, blocked isocyanate, oxazoline group-containing polymers, and silane coupling agents; pH adjusters such as potassium hydroxide and ammonia; thickeners such as polyacrylic acids and carboxymethyl cellulose; pigments; antioxidants; and the like.

The electrically conductive film 50 may be configured as a non-foamed coating layer, a foamed coating layer, or a laminate thereof.

The electrically conductive film 50 may penetrate into a part of the glove main body 10 in the thickness direction but is positioned at least further on an outer side than the glove main body 10. It is considered that a thickness of the electrically conductive film 50, which is positioned outside the glove main body 10, is greatly involved in a volume resistance value of the glove 2, and this thickness is preferably no less than 0.01 mm and no greater than 1.0 mm. By setting the thickness to fall within the above range, durability of the electrically conductive film 50 and flexibility of the glove 2 can be easily ensured.

In the repeating structure 40 on which the electrically conductive film 50 of the glove 2 is laminated, the lower limit of the volume resistance value specified in EN 61340-2-3 is preferably $3.5\times10^{3}\Omega$ and more preferably $1.0\times10^{4}\Omega$. On the other hand, the upper limit of the volume resistance value is preferably $1.0\times10^{8}\Omega$ and more preferably $1.0\times10^{7}\Omega$. When the volume resistance value is less than the lower limit, an electrical short circuit failure may occur at the time of gripping an object for gripping. Conversely, when the volume resistance value is greater than the upper limit, the worker may be susceptible to electrification.

In the repeating structure 40 on which the electrically conductive film 50 of the glove 2 is laminated, the lower limit of the surface resistance value specified in EN 61340-2-3 is preferably $3.5\times10^{3}\Omega$ and more preferably $1.0\times10^{4}\Omega$. The upper limit of the surface resistance value is preferably $1.0\times10^{8}\Omega$ and more preferably $1.0\times10^{7}\Omega$. By thus setting the surface resistance value to fall within the above range, while maintaining performance for protecting an electronic component, explosion-proof performance can be further improved, and operability of a touch panel can be improved.

A yarn obtained by covering a spandex core yarn with nylon fiber is preferably disposed by plating knitting in a region of the front face of the main body portion 10*a*, the region being coated with the electrically conductive film 50. By thus disposing the yarn obtained by covering the spandex core yarn with the nylon fiber by plating knitting in the region of the front face of the main body portion 10*a*, the region being coated with the electrically conductive film 50, adhesiveness to the electrically conductive film 50 can be improved, and volume resistance value controllability and durability of the glove 2 can be improved. Furthermore, due to contraction force of the spandex, stitches are easily opened, and the electrically conductive film 50 can easily penetrate into an inner face of the glove. Thus, the electrically conductive yarn 21, which constitutes the electrically conductive part 20, can be easily covered with the electrically conductive film 50, and the abrasion-preventing effect of the electrically conductive yarn 21 can be improved.

Method for Manufacturing Glove

The glove 2 can be manufactured by a manufacturing method including a preparing step, a knitting step, an inside-out turning step, a compound-preparing step, and a laminating step.

Preparing Step, Knitting Step, and Inside-Out Turning Step

In the preparing step, the electrically conductive composite yarn 22 and the electrically non-conductive yarn 31 are prepared. In the knitting step, the glove main body 10 is knitted with a flat knitting machine by using the yarns prepared in the preparing step. In the inside-out turning step, the glove main body 10 after the knitting step is turned inside out. Each of these steps can be carried out in a manner similar to the method for manufacturing the glove 1 of the first embodiment, and therefore, detailed description thereof is omitted.

Compound-Preparing Step

In the compound-preparing step, a film raw material compound for forming the electrically conductive film 50 is prepared. The compound-preparing step may, as long as it precedes the laminating step, be conducted before or after other steps. For example, the compound-preparing step may be performed concurrently with the preparing step.

The film raw material compound is prepared as a latex, a resin solution, or a resin sol, and for example, an electrically conductive filler is added to impart electrical conductivity.

In the case in which a main component of the film raw material compound is a latex, examples thereof include latexes such as a natural rubber, an acrylonitrile butadiene rubber, a chloroprene rubber, an acrylic rubber, an isoprene rubber, a styrene-isoprene block copolymer, a silicone rubber, an acrylic rubber, and the like. Of these, in light of versatility, adhesiveness to the fiber of the glove main body 10, flexibility, and abrasion resistance, a natural rubber, an acrylonitrile butadiene rubber, and a chloroprene rubber latex are preferred.

Furthermore, in the case in the main component is the resin, the resin solution can be exemplified by a polyurethane solution, a silicone rubber solution, and the like, and the resin sol can be exemplified by a polyvinyl chloride sol and the like.

The film raw material compound may contain the above-described various types of compounding agents in addition to the rubber or a resin composition for forming the electrically conductive film 50. Furthermore, in a case in which the electrically conductive film 50 is made porous, aside from a chemical foaming agent and/or a thermally expandable microcapsule, a foaming agent and/or a foam stabilizer may be added to mechanically foam the raw material.

Laminating Step

In the laminating step, the electrically conductive film 50 is laminated on a desired site of the glove main body 10.

The electrically conductive film 50 can be formed in the following manner: after the glove main body 10 is put on a hand mold, the film raw material compound is applied to the glove main body 10 by any of four methods of: (1) a method in which the glove main body 10 being heated is reacted with a latex compound having high thermal coagulability; (2) a method in which the glove main body 10 is dipped in a coagulant, e.g., a solution of calcium nitrate in methanol and then reacted with the latex raw material compound; (3) a method in which the glove main body 10 is dipped in a solution of polyurethane in dimethylformamide, followed by precipitating the polyurethane in water; and (4) a method in which the glove main body 10 is subjected to oil-repellent processing and dipped in a polyvinyl chloride sol; and then heating is performed. In this case, in light of preventing peeling, maintaining flexibility, and imparting electrical conductivity, a part in which the electrically conductive film 50 is in direct contact with the glove main body 10 preferably penetrates in a range of no less than 10% and no greater than 70% of an average thickness of the glove main body 10.

After the electrically conductive film 50 is laminated, further heat curing is performed by vulcanization, cross-linking, and/or the like to increase strength of the electrically conductive film 50, and the glove is removed from the hand mold to obtain the glove 2. It is to be noted that at any timing from the laminating the electrically conductive film 50 to the removing the glove 2 being thermally cured, a water-washing step of washing the glove 2 with water may be provided to remove excess coagulant, emulsifier, vulcanization accelerator, etc. from the glove 2.

Furthermore, a surface of the electrically conductive film 50 may be subjected to known anti-slip processing. Examples of a method for imparting anti-slip properties include: a method in which an outer face of the electrically conductive film 50 is made uneven by using particles; a method in which a foam layer is formed as the electrically conductive film 50; a method in which an electrically conductive foam layer is further provided on the outer face of the electrically conductive film 50; a method in which at a time of forming the electrically conductive film 50, deliquescent particles are applied to the electrically conductive film 50 before heating and removed after the heating to form a concave shape; a method in which at the time of forming the electrically conductive film 50, the electrically conductive film 50 is swollen by a solvent to give an uneven pattern; a method in which unevenness is formed by pressing; and the like.

Advantages

In the glove 2, with respect to the electrically non-conductive part 30, which is positioned in the convex portion 30*a* and disposed such that the electrically conductive part 20 is interposed therein, the electrically conductive part 20 is positioned in the concave portion 20*a*, and thus, the electrically conductive part 20 does not come into strong contact with an object for gripping. Accordingly, the glove 2 enables preventing abrasion of the electrically conductive yarn 21. Moreover, in the glove 2, since the electrically conductive yarn 21 is disposed across the front face and the back face of the main body portion 10*a*, the volume resistance value which shows electrical conductivity between the front and back faces of the glove 2 can easily fall within the certain range.

Since the glove 2 includes the electrically conductive film 50, in a case in which the front face is abraded, the main body portion 10*a* is abraded preferentially from the convex portion 30*a*, and thus, the concave portion 20*a* is less likely to be abraded to the end. Accordingly, the abrasion-preventing effect of the electrically conductive yarn 21 is improved.

Furthermore, owing to the electrically conductive film 50, which coats the part or the entirety of the repeating structure 40 of the main body portion 10*a*, anti-slip performance can be imparted, and durability of the glove 2 can be improved.

In the case in which the electrically conductive film 50 coats the part of the repeating structure 40 of the main body portion 10*a*, with regard to the repeating structure 40 which is not coated, protrusion of the electrically conductive yarn 21 beyond the outermost face of the glove 2 can be inhibited by winding the electrically conductive yarn 21 on the core yarn 23 having the lower elongation rate. Thus, strong contact of the electrically conductive part 20 with an object for gripping can be inhibited more surely, and accordingly, the abrasion-preventing effect of the electrically conductive yarn 21 can be improved. Moreover, along with the fact that the electrically conductive part 20 does not directly come into strong contact with an object for gripping, volume resistance value controllability can be improved.

Other Embodiments

The present invention is not limited to the above embodiments and may be carried out in various modified and improved modes in addition to the aforementioned modes.

In the above embodiment, as the method for manufacturing a glove, the case of using only the electrically conductive composite yarn in the electrically conductive part is described; however, for example, a single covered yarn (SCY) covered with a spandex may be knitted as a plating yarn to be aligned with the electrically conductive composite yarn.

EXAMPLES

Hereafter, the present invention is described further in detail by way of Examples; however, the invention is not limited to the Examples below.

Preparing Step

The following yarns were prepared.

Electrically Conductive Composite Yarn

As the electrically conductive composite yarn, an electrically conductive composite yarn (elongation rate: 0%) including a cut-resistant yarn of 280 dtex (3GX20-280, manufactured by DSM; elongation rate: 0%) as the core yarn, being covered with an electrically conductive yarn of 22 dtex (Clacarbo, manufactured by Kuraray Co., Ltd.; elongation rate: 2.0%) at 200 times/m, was prepared.

Electrically Non-Conductive Yarn

As the electrically non-conductive yarn, a single yarn of a cut-resistant yarn of 280 dtex (3GX20-280, manufactured by DSM) and a plating yarn thereof were prepared. As the plating yarn, a single covered yarn (elongation rate: 220%) obtained by covering using a spandex of 22 dtex as a core yarn and a single yarn of wooly nylon of 77 dtex at a draft of 3.0 and 400 times/m was used. The elongation rate of the electrically non-conductive yarn (combination of the single yarn and the plating yarn) was 219%.

Knitting

A glove main body was knitted using an 18G flat knitting machine (SFG-i, manufactured by SHIMA SEIKI MFG., LTD.) in such a manner that a cut-resistant yarn of the electrically non-conductive yarn was fed to a main yarn feeder, a plating yarn of the electrically non-conductive yarn was fed to a plating yarn feeder, and the electrically conductive composite yarn was fed to a two-color switching feeder.

Figure 7:
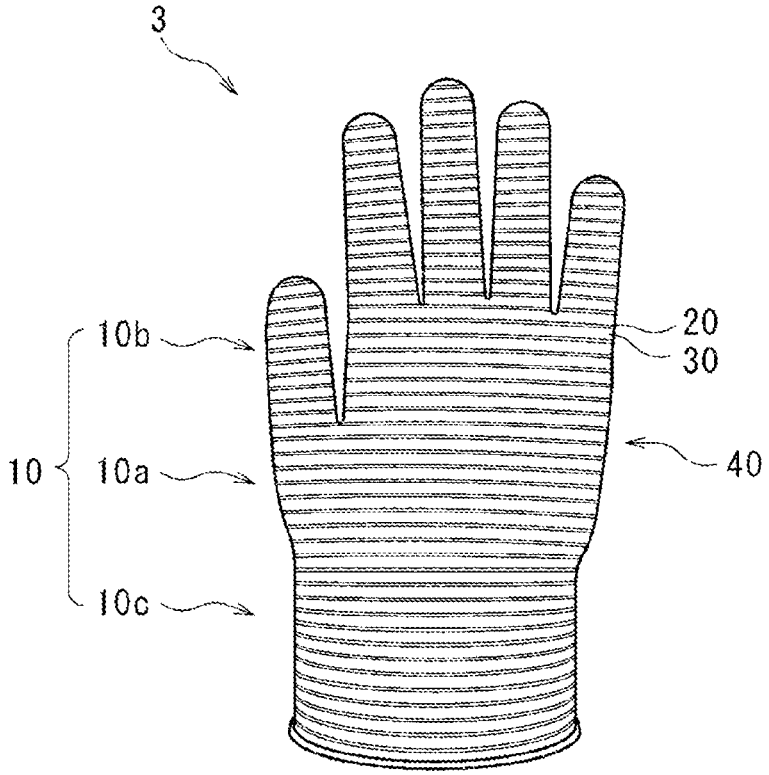
FIG. 7 is a schematic perspective view from a palm side of a glove in Examples.

As illustrated in FIG. 7, in the glove main body 10 of a glove 3 in the Example, the main body portion 10*a*, the finger-receiving portions 10*b*, and the cuff portion 10*c* were knitted to have the repeating structure 40. Specifically, the main body portion 10*a* was knitted by a repeating operation in which the two-color switching feeder was moved by 1 course and then the main yarn feeder and the plating yarn feeder were moved by 3 courses. The cuff portion 10*c* was knitted by, in addition to the repeating operation, inlay knitting of an elastic yarn (yarn obtained by covering a spandex of 330 dtex as a core yarn with a polyester yarn of 83 dtex) in a proportion of 1 course to 3 courses to improve fitting properties of the cuff portion 10*c*. It is to be noted that the number of courses per unit length of the palm part was set to 42 courses/inch.

The glove main body 10 after the knitting was turned inside out to obtain the glove desired.

When resistance values of a palm part and a dorsal hand part of the glove 3 were measured in conformity with EN 61340-2-3, surface resistance values were $2.1\times10^4\Omega$ and $3.9\times10^4\Omega$, and volume resistance values were $1.8\times10^4\Omega$ and $2.5\times10^4\Omega$. Furthermore, a cut level measured in conformity with EN388 standard was C.

Resin Coating

An electrically conductive film made of a resin was laminated on the glove 3 to fabricate a glove having the configuration illustrated in FIGS. 5 and 6 by the following procedure.

Firstly, a film raw material compound was prepared in such a manner that dimethylformamide (DMF) was added to a polyurethane resin solution (Chrisbon 8366HV, manufactured by DIC Corporation) such that a resin component accounted for 10% by mass, followed by adding an electrically conductive filler (Dentall WK-500B, manufactured by Otsuka Chemical Co., Ltd.) such that a proportion thereof was 35 parts by mass with respect to 100 parts by mass of the resin component.

The above-described glove 3 was put on a hand mold, and a palm part of the hand mold was dipped in the film raw material compound, pulled up, and then placed in water for 1 hr. Moreover, after being pulled up, the hand mold was heated in an oven at 120° C. for 30 min. The hand mold was cooled, and then, only the hand mold was pulled out from the glove to obtain the glove desired.

When resistance values of the palm part and the dorsal hand part of the glove were measured in conformity with EN 61340-2-3, surface resistance values were $3.1\times10^4\Omega$ and $5.8\times10^4\Omega$, and volume resistance values were $4.5\times10^4\Omega$ and $4.3\times10^4\Omega$. Furthermore, a level of an abrasion resistance of the palm part measured in conformity with the EN388 standard was 4.

Rubber Coating

An electrically conductive film made of a rubber was laminated on the glove 3 to fabricate a glove having the configuration illustrated in FIGS. 5 and 6 by the following procedure.

A film raw material compound was prepared in such a manner that with respect to 100 parts by mass of a rubber component, 0.4 parts by mass of methyl cellulose, 3.8 parts by mass of EC300J being a dispersion of Ketjen Black, manufactured by LION SPECIALTY CHEMICALS CO., LTD., 2 parts by mass of zinc oxide, and 0.5 parts by mass of calcium hydroxide were added as effective components to an NBR latex (Lx550, manufactured by Zeon Corporation) and dispersed well.

The above-described glove 3 was put on a hand mold, and a palm part of the hand mold was dipped in a solution of 1% by mass of calcium nitrate in methanol, and then dipped in the film raw material compound, and pulled up, followed by heating in an oven at 70° C. for 30 min and in the oven at 120° C. for 40 min. The hand mold was cooled, and then only the hand mold was pulled out from the glove to obtain the glove desired.

When resistance values of the palm part and the dorsal hand part of the glove were measured in conformity with EN 61340-2-3, surface resistance values were $9.4\times10^5\Omega$ and $8.1\times10^4\Omega$, and volume resistance values were $7.2\times10^6\Omega$ and $9.1\times10^4\Omega$. Furthermore, the level of the abrasion resistance of the palm part measured in conformity with the EN388 standard was 4.

INDUSTRIAL APPLICABILITY

As described above, the glove of the present invention has a volume resistance value that easily falls within a certain range and is superior in durability.

EXPLANATION OF THE REFERENCE SYMBOLS

1, 2, 3 Glove
10 Glove main body
10*a* Main body portion
10*b* Finger-receiving portion
10*c* Cuff portion
20 Electrically conductive part
20*a* Concave portion
21 Electrically conductive yarn
22 Electrically conductive composite yarn
23 Core yarn
30 Electrically non-conductive part
30*a* Convex portion
31 Electrically non-conductive yarn
40 Repeating structure
50 Electrically conductive film

What is claimed is:

1. A glove comprising:

a glove main body knitted with a yarn made of fiber, the glove main body comprising:
a main body portion;
five finger-receiving portions each having a bottomed cylindrical shape; and
a cylindrical cuff portion, wherein the main body portion is formed into a bag shape configured to cover a palm and a dorsal side of a wearer's hand, the five finger-receiving portions extend from the main body portion configured to cover each of a first finger to a fifth finger of the wearer, and the cylindrical cuff portion extends in a direction opposite to the five finger-receiving portions, in at least a part of a palm part of the main body portion, the main body portion comprises a repeating structure of: a strip-shaped electrically conductive part comprising an electrically conductive yarn; and a strip-shaped electrically non-conductive part not comprising the electrically conductive yarn, the main body portion comprises unevenness on a front face thereof, in which the strip-shaped electrically conductive part is a concave portion and the strip-shaped electrically non-conductive part is a convex portion, the strip-shaped electrically conductive part consists of an electrically conductive composite yarn comprising: the electrically conductive yarn; and a core yarn covered with the electrically conductive yarn, the electrically conductive yarn is disposed across the front face and a back face of the main body portion, an elongation rate of the core yarn is no greater than 3%, and a volume resistance specified in EN 61340-2-3 measured from a central portion of the repeating structure of the palm part is no less than $10^3\Omega$ and no greater than $10^8\Omega$.

2. The glove according to claim 1, wherein the elongation rate of the core yarn is lower than an elongation rate of the electrically conductive yarn.

3. The glove according to claim 1, wherein a fineness ratio of an electrically non-conductive yarn, which constitutes the strip-shaped electrically non-conductive part, to the electrically conductive composite yarn is no less than 1.08.

4. The glove according to claim 3, wherein an elongation rate of the electrically non-conductive yarn is higher than an elongation rate of the electrically conductive composite yarn.

5. He glove according to claim 1, wherein the core yarn is a cut-resistant yarn.

6. The glove according to claim 5, wherein:

the electrically non-conductive yarn consists of a cut-resistant yarn and a plating yarn, and the plating yarn is a single covered yarn obtained by covering a spandex core yarn.

7. The glove according to claim 1, further comprising an electrically conductive film made of a resin or a rubber, the electrically conductive film coating a part or an entirety of the repeating structure of the main body portion.

8. The glove according to claim 7, wherein a yarn obtained by covering a spandex core yarn with nylon fiber is disposed by plating knitting in a region of the front face of the main body portion, the region being coated with the electrically conductive film.

* * * * *